United States Patent [19]

Obbermito

[11] Patent Number: 4,686,785

[45] Date of Patent: Aug. 18, 1987

[54] DEVICE ADAPTED TO BE FIXED TO CRASH BARRIER GUARD RAIL

[75] Inventor: Antonio Obbermito, Turin, Italy

[73] Assignee: Ovas S.a.s. di A. Obbermito & C., Turin, Italy

[21] Appl. No.: 756,646

[22] Filed: Jul. 19, 1985

[30] Foreign Application Priority Data

Jul. 23, 1984 [IT] Italy ..... 53662/84[U]
Apr. 15, 1985 [IT] Italy ..... 53236/85[U]

[51] Int. Cl.[4] ..... G09F 15/00

[52] U.S. Cl. ..... 40/606; 40/602; 40/611; 40/612

[58] Field of Search ..... 40/612, 602, 606, 611, 40/607; 256/13.1; 404/6, 16; 248/231.8; 116/63 P

[56] References Cited

U.S. PATENT DOCUMENTS

| | | | |
|---|---|---|---|
| 536,379 | 3/1895 | Gilham et al. | 248/231.8 |
| 1,444,077 | 2/1923 | Koehn | 40/606 |
| 1,491,636 | 4/1924 | Sanfacon | 40/607 |
| 1,599,928 | 9/1926 | Sweeney | 40/608 |
| 1,901,333 | 3/1933 | Parkhurst | 404/10 |
| 2,033,024 | 3/1936 | Burden | 40/610 |
| 2,110,555 | 3/1938 | Pfaff, Jr. | 40/607 |
| 2,193,747 | 3/1940 | Thompson | 116/175 |
| 2,409,076 | 10/1946 | Steinberger et al. | 40/607 |
| 2,752,709 | 7/1956 | Gough | 248/231.8 |
| 3,023,725 | 3/1962 | Boyd | 116/63 P |
| 3,085,546 | 4/1963 | Pelletier | 116/63 P |
| 3,312,156 | 4/1967 | Pellowski | 404/15 |
| 3,468,567 | 9/1969 | Attwood et al. | 256/13.1 |
| 3,646,696 | 3/1972 | Sarkisian | 40/602 |
| 3,662,482 | 3/1972 | Sarkisian | 40/602 |
| 3,863,595 | 2/1975 | Barnett et al. | 116/63 R |
| 3,863,873 | 2/1975 | Cushing | 248/231.8 |
| 3,929,310 | 12/1975 | Peham | 248/231.8 |
| 4,000,882 | 1/1977 | Penton | 256/13.1 |
| 4,038,769 | 8/1977 | Werner | 40/610 |
| 4,090,465 | 5/1978 | Bell, Sr. | 116/63 R |
| 4,111,581 | 9/1978 | Auriemma | 404/10 |
| 4,134,643 | 1/1979 | Lee | 350/97 |
| 4,137,662 | 2/1979 | Baumer | 40/612 |
| 4,205,472 | 6/1980 | Shirley | 40/608 |
| 4,365,435 | 12/1982 | Snyder, Jr. | 40/608 |

FOREIGN PATENT DOCUMENTS

| | | | |
|---|---|---|---|
| 0083983 | 7/1983 | European Pat. Off. . | |
| 879816 | 7/1949 | Fed. Rep. of Germany . | |
| 1934656 | 3/1971 | Fed. Rep. of Germany . | |
| 2020511 | 11/1971 | Fed. Rep. of Germany . | |
| 1150240 | 1/1958 | France . | |
| 1222747 | 6/1960 | France . | |
| 2436455 | 5/1980 | France | 40/607 |
| 7414358 | 5/1976 | Netherlands | 256/13.1 |
| 311767 | 5/1930 | United Kingdom . | |

*Primary Examiner*—Gene Mancene
*Assistant Examiner*—Cary E. Stone
*Attorney, Agent, or Firm*—Robbins & Laramie

[57] ABSTRACT

The device comprises at least one reflective flag carried by a lateral rod in its turn carried by a lower bracket. The bracket is constituted by a strip of stainless steel sheet or other weather-resistant material, shaped as an arcuate hairpin for gripping the upper part of the guard rail resiliently. In one embodiment, the flag is mounted on the rod so as to be pivotable and is biassed by a spring into a position in which it projects towards the carriageway.

Preferably the flag includes a frame in which replaceable reflective sheets are inserted.

24 Claims, 7 Drawing Figures

DEVICE ADAPTED TO BE FIXED TO CRASH BARRIER GUARD RAIL

The present invention relates to a road sign device which can be fixed to E-section guard rails of crash barriers, comprising at least one reflective flag carried by a lateral rod in its turn carried by a lower fixing bracket.

Devices of this type are widely known and very widespread on motorways. They comprise, in the simplest and most widely used type, a flag or two opposing reflective flags of rigid plastics material which are fixed to a rod having a bracket or base structure at its lower end which is fixed by bolts to a support pillar for the guard rail. The Applicant does not know of any Patent documents relating to such known devices.

The object of the invention is to provide sign devices of the type mentioned above which lend themselves to installation on crash barrier guard rails rapidly and economically, even temporarily, at any desired intervals, without requiring holes to be made in the guard rail.

According to the present invention this object is achieved by means of a device of the type mentioned at the beginning, characterised in that the bracket is constituted by a strip of weather-resistant resilient material shaped substantially as a hairpin with extradotal and intradotal arms which have the arcuate profile of the upper part of the guard rail, these arms being intended to grip this upper part resiliently.

This solution offers the advantage of allowing sign devices to be fixed rapidly and economically at any desired spacing, and their equally rapid and economical replacement whenever they are damaged. The economy is considerable, particularly when they are fixed to blackened or rusty guard rails so as to make them more visible, since the cost of cleaning, re-painting or replacing the guard rails would be greater than that of the devices themselves.

Figure 5:
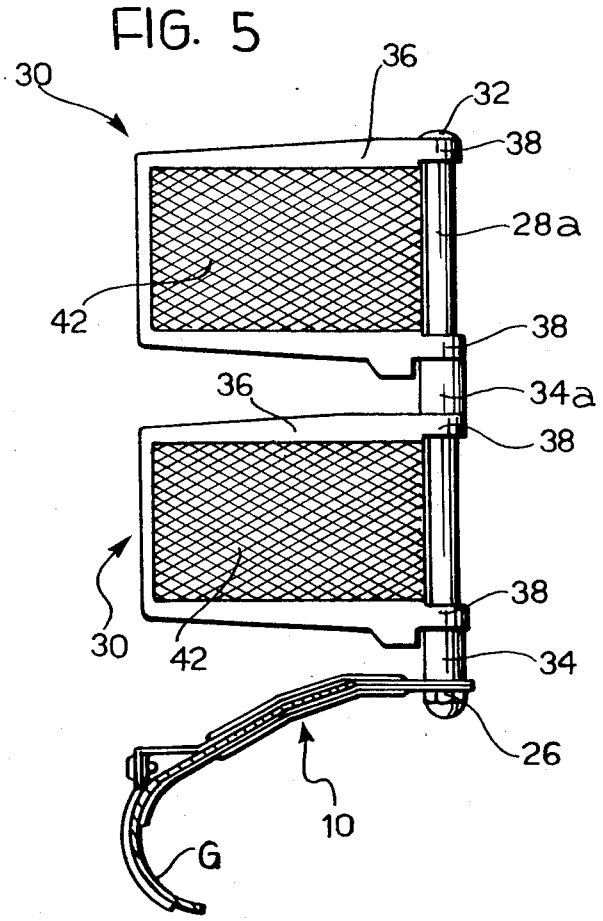
Figure 1:
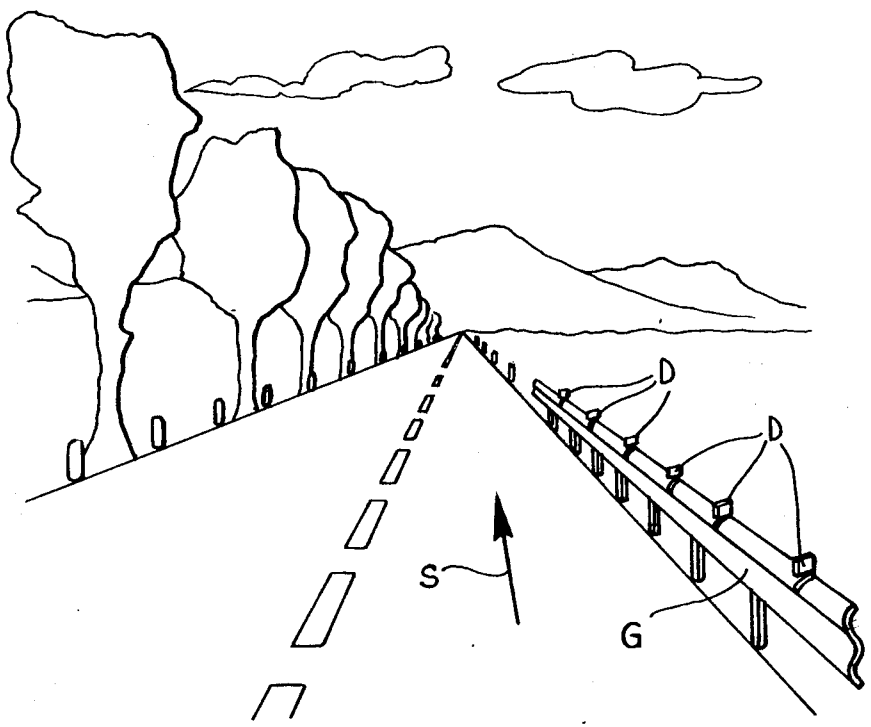
Figure 2:
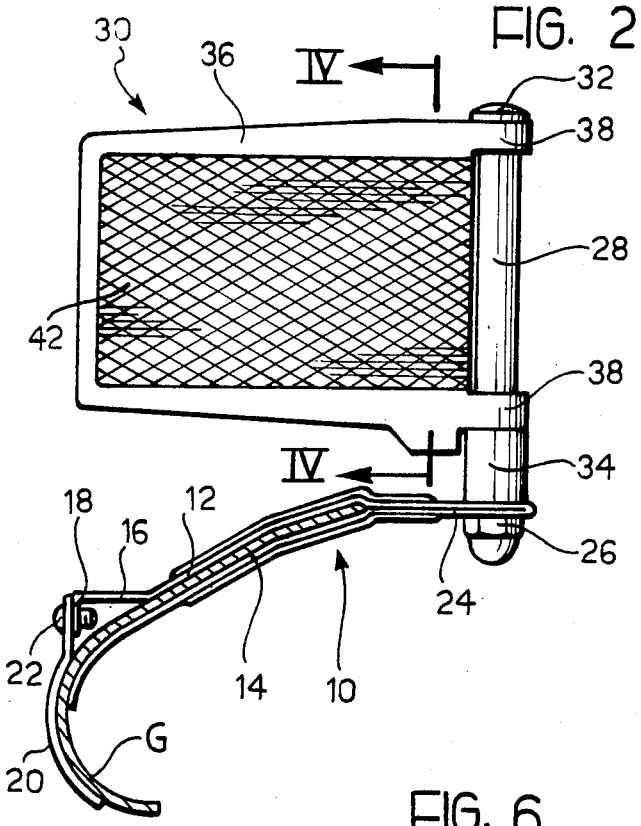
Figure 4:
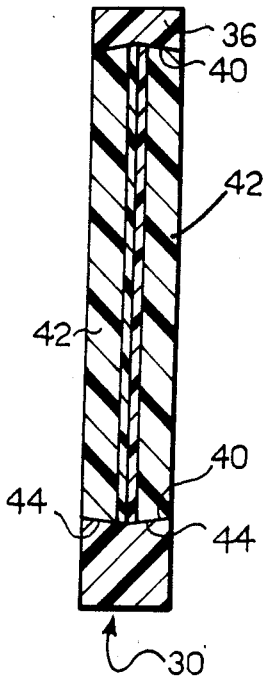
Figure 6:
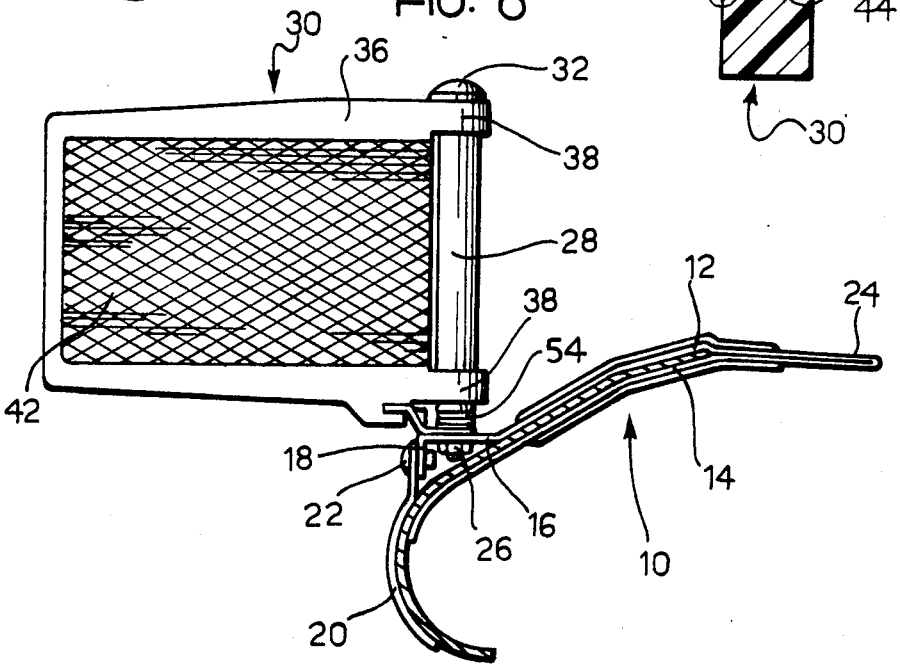
Figure 3:
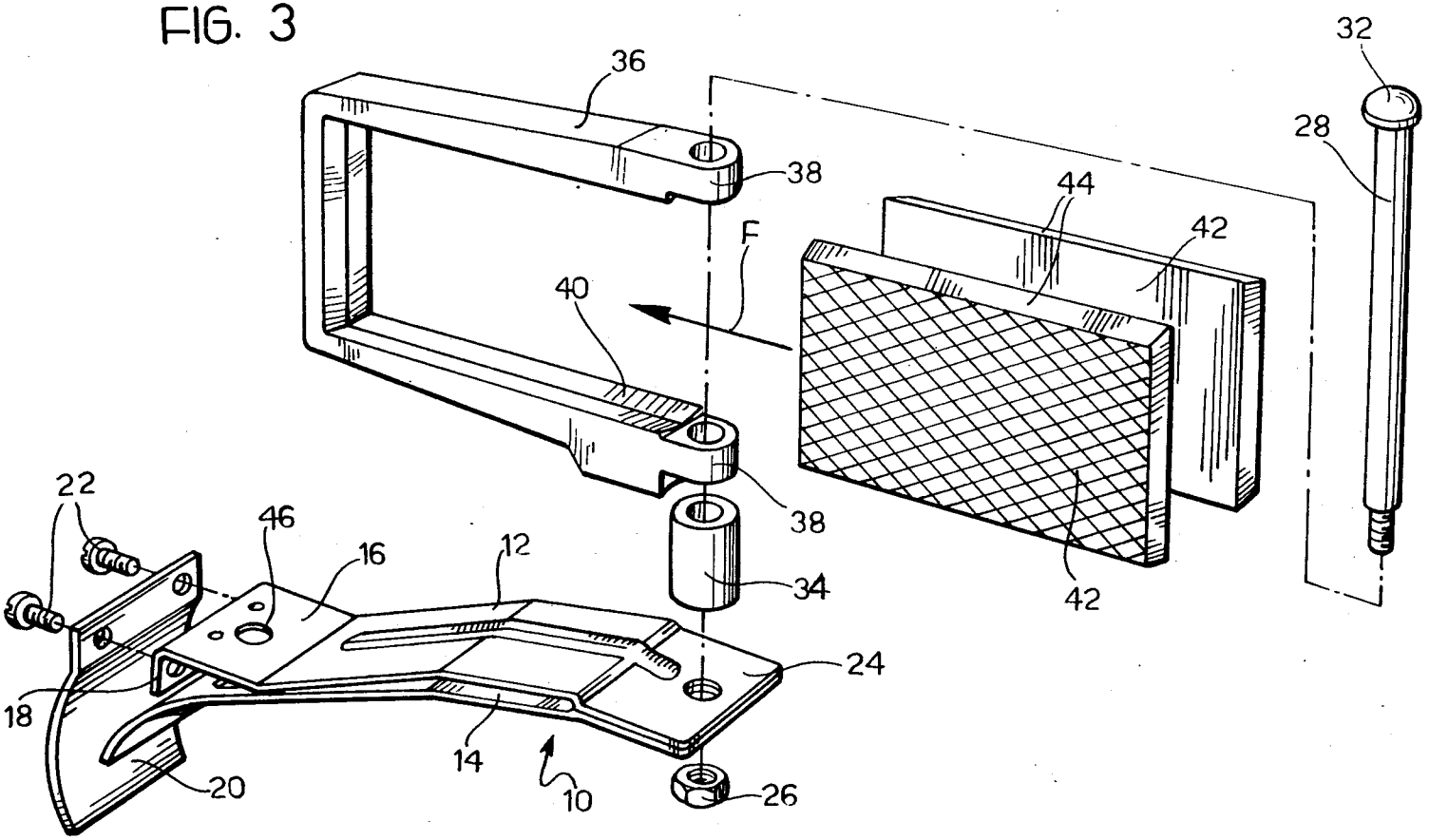
Figure 7:
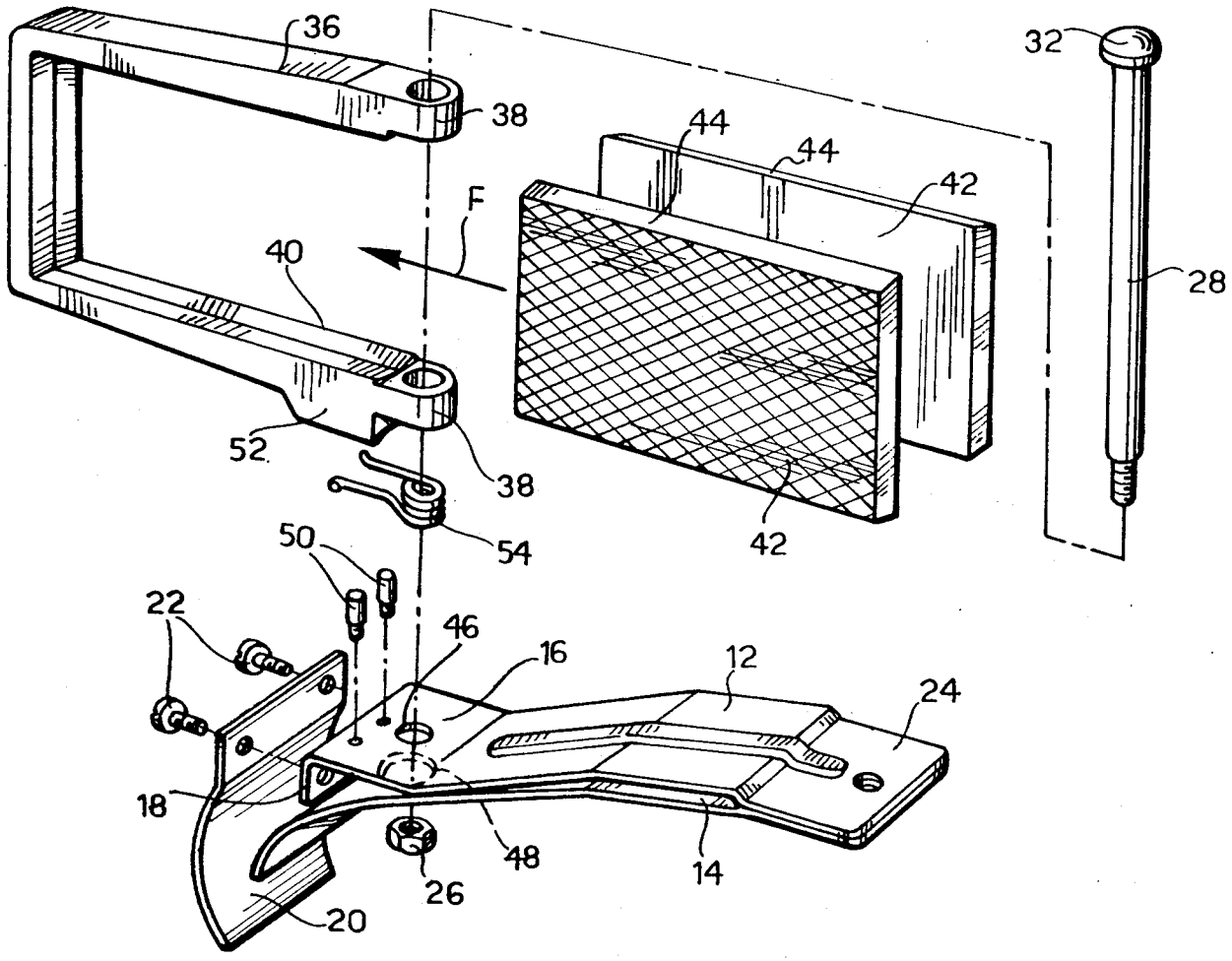

The invention also has other advantageous characteristics which, among other things, increase the versatility of the devices and make them easier to assemble. These characteristics will become apparent from a reading of the detailed description which follows, with reference to the appended drawings given by way of non-limiting example, in which:

FIG. 1 is a pictorial representation of a stretch of carriageway one side of which is flanked by a crash barrier provided with sign devices according to the invention, FIG. 2 is an elevational view of a fixed version of the device, installed on a crash barrier, the upper part of which is shown in section, FIG. 3 is an explosed perspective view of the device of FIG. 2, FIG. 4 is a cross-sectional view, on an enlarged scale, taken in the plane IV—IV of FIG. 2, FIG. 5 is an elevational view similar to FIG. 2, of a version of the device with two superposed clamped flags, FIG. 6 is an elevational view similar to FIG. 4, of the version of the device with a pivotable flag, and FIG. 7 is an exploded perspective view of the device of FIG. 6.

With reference to FIG. 1, a stretch of carriageway on which it is supposed that the direction of travel is that indicated by the arrow S is flanked on the right hand side by a crash barrier having a guard rail G of well known E-section. The crash barrier is provided with a series of sign devices D according to the invention at regular intervals.

Reference will now be made to FIGS. 2 to 4. In FIG. 2, the upper part of of the guard rail is again indicated G.

The sign device includes a bracket 10 for fixing to the guard rail G. This bracket 10 is constituted by a strip of weather-resistant resilient material such as stainless steel or brass sheet, or of plastics material. The bracket 10 comprises a hairpin part with an extradotal arm 12 and intradotal arm 14 shaped according to the arcuate profile of the upper part of the guard rail G, as illustrated in FIG. 2. This hairpin part is intended to grip the upper part of the guard rail G resiliently. This system allows the rapid mounting of the sign device without the need to make holes in the guard rail or to use screws or other clamping, or welding systems etc.

The extradotal part 12 has a ledge part 16 at its free end which is horizontal in the installed condition and which has a free edge portion 18 bent downwardly at right angles.

Preferably, the edge portion 18 has an associated foot 20 of sheet metal or other weather-resistant material also preferably stainless steel or brass. The foot 20 is curved so as to embrace the upper convex part of the guard rail G on that side facing the carriageway and can be fixed to the edge portion 18 by means of self-tapping screws 22 or ordinary screws with nuts. The presence of the foot 20 prevents the bracket 10 from becoming detached from the guard rail G accidentally and also deters unauthorised removal of the device.

The bracket 10 has an apertured tab 24 which extends from the loop of the hairpin part 12–14 so as to project from the guard rail G on its side opposite the roadway. The lower threaded end of the lateral support rod 28 for a flag 30, which will be described in detail below, is fixed to the tab by means of a nut 26. The flag 30 is fixed to the rod 28 by clamping between a head 32 of the rod itself and a spacer bush 34 interposed between the lower part of the flag 30 and the tab 24.

The flag 30 comprises a frame 36 which is preferably of relatively soft, colourless, weather-resistant and knock resistant plastics material. The frame 36 is open towards the rod 28 where the ends of its arms are shaped as apertured lugs 38. The rod 28 is fitted into these lugs 38.

The frame 36 has a groove 40 in the form of an obtuse dihedron around its inner periphery. The frame 36 has an associated pair of opposing reflective sheets 42 (or a single reflective sheet). The two sheets 42 have bevelled edges 44 with semi-dihedral angles corresponding to those of the groove 40.

The sheets 42 are assembled in the frame 36 by placing together their faces opposite the reflective faces and then fitting them into the groove 40 in the direction of the arrow F in FIG. 3. After the sheets 42 have been inserted in the frame 36 in this way, the rod 28 is inserted into the lugs 38. The sheets 42 are thus trapped in the frame 36. The bush 34 is then fitting onto the lower part of the rod 28 and finally the whole is fixed to the tab 24 by the nut 26.

As will be understood, the sheets 42 selected may be assembled even at the installation site of the sign device without the need for any particular skill. Also no particular skill is needed for mounting the bracket 10 or the crash barrier guard rail.

As may be seen from FIG. 2, the flag 30 is clamped parallel to the extent of the bracket 10, that is transverse the carriageway. The flag is of such a size as not to project beyond the bulk shape of the crash barrier towards the carriageway.

FIG. 5 illustrates the possibility of using two superposed flags in a single sign device. All the parts identical to those of FIGS. 2 to 4 are indicated by the same reference numerals and their description will not be repeated.

The device of FIG. 5 is made up with the use of two flags 30 which are identical to that already described and a rod 28*a* which is of such a length as to receive these two flags and to accommodate a further spacing bush 34*a* between the adjacent lugs 38 of the flags themselves.

With reference now to FIGS. 6 and 7, a further mode of assembly of a sign device according to the invention, with the use of the same basic structure, will be described.

The device of FIGS. 6 and 7 again includes a bracket 10 identical to that of the preceding Figures and the elements of which are again indicated by the same references.

In this case the ledge 16 already mentioned with reference to FIGS. 2 and 3 is used for attaching the flag again indicated 30. The tab 24 is unused.

The ledge 16 has a hole 46 for fixing the rod 28 by means of a nut, again indicated 26. An aperture 48 is formed in the intradotal arm 14 of the bracket 10 for access by a spanner for turning the nut 26.

A pair of abutment pins 50 is also fixed to the ledge 16.

The lower arm of the frame 36 of the flag 30 has a projection 52.

The spacer 34 of FIGS. 2 and 3 is replaced by a hairpin spring 54 wound helically around the rod 28 beneath the lower lug 38. The two pins 50 are embraced by the arms of the spring 54. These arms also embrace the projection 52. Thus the flag is pivotable about the vertical axis of the rod 28 and is urged resiliently by the spring 54 to a position in which it projects from the guard rail G towards the carriageway.

If the flag is deflected in one direction by being hit by a vehicle, the arm of the spring 54 which engages the face of the projection 52 facing forwardly with respect to the sense of rotation remains applied against the projection itself while the other arm bears against the respective pin 50 to deform the spring 54 and produce the resilient return force.

If a crash barrier guard rail is provided with a series of devices mounted at regular intervals as in FIGS. 6 and 7, the side of a vehicle which approaches too close to the crash barrier and is about to brush against it is hit by a succession of flags. This alerts the driver to the danger because of the rhythmic noise due to the succession of bumps against the flags. These latter, being resiliently yieldable and preferably having a frame of relatively soft plastics material, do not damage the bodywork.

In addition to the advantages mentioned above, the sign devices according to the invention also have the following advantages.

optimal visibility, being in a raised position; good self-cleaning from dust by virtue of the vibrations to which the flag is subject either because of its mounting on the cantilevered tab 24 or its pivotable mounting;

additional visibility in the event of covering of signs applied to the concave zone of the guard rail by falling leaves, snow or fog;

guaranteed durability due to the ease of replacement of worn or damaged parts and use of weather-resistant plastics material or brass or stainless steel;

possibility of application of two or more flags to a single bracket, for example, combining the configuration of FIG. 5 with that of FIG. 6.

What is claimed is:

1. Road sign device used for fitment to road side E-section guard rails of crash barriers, said E section having an upper convex part, comprising in combination:

reflective flag, a lateral support rod carrying said reflective flag, and a lower fixing bracket carrying said support rod, wherein said bracket comprises a strip of weather-resistant resilient material shaped substantially as a hairpin with extradotal and intradotal arms which have the same arcuate profile as the upper convex part of the guard rail to grip said upper part said extradotal arm including a free end, an associated foot and screw means for fixing said foot to said, extradotal arms, said foot being curved to embrace said upper convex part to prevent detachment of the bracket from the guard rail.

2. Device as defined in claim 1 wherein the bracket includes an apertured tab which extends from the foot of the hairpin so as to project from the guard rail away from the road for the selective fixing of the lower end of the rod to the apertured tab, with the flag clamped angularly on the rod in a position in which it projects towards the road within the profile shape of the guard rail and wherein said bracket further includes, towards the free end of said extradotal arm, an apertured ledge to which the lower end of said rod may be selectively fixed, and means urging said flag resiliently to a position in which it projects from the guard rail towards the road.

3. Device as claimed in claim 2 in which the position of the flag projects within the profile of the shape of the guard rail.

4. Device as defined in claim 1, wherein the flag comprises:

a square C-shaped frame which is open towards the rod including arms ending with apertured lugs into which lugs said rod is fitted and retained removably, said frame having a groove around its inner periphery, and a reflective sheet which is located releasably in the frame with its edges engaged in the groove, the removal of said sheet from the open side of the frame being prevented by the lateral rod fitted into the lugs.

5. Device as defined in claim 4, wherein two opposing reflective sheets are mounted back-to-back in the frame.

6. Device as defined in claim 5, wherein the groove in the frame is in the form of a dihedron and the edges of the two opposing reflective sheets are engaged in said groove, said edges being bevelled with semi-dihedral angles corresponding to those of said groove.

7. Device as defined in claim 4, wherein said frame is of plastics material.

8. Device as defined in claim 7, wherein the plastics material of the frame is relatively soft and resistant to knocks.

9. Device as defined in claim 4, wherein the rod is screw threaded at its lower end and has a head at its upper end for abutting a corresponding upper end of the lugs, and the lower threaded end of the rod has an associated threaded member for fixing to the bracket, and including at least one spaceer member located between the other lug and the bracket surrounding the rod.

10. Device as defined in claim 9, characterised in that the spacer member is a rigid bush which prevents rotation of the flag by virtue of the clamping of the lugs between the head of the rod and the bush.

11. Device as defined in claim 10, wherein the rod is of such a length as to receive two opposing flags and including a further spacing bush interposed between the adjacent lugs of the two flags.

12. Device as defined in claim 9, characterised in that the flag is pivotable on the rod by means of its lugs, and the spacer member includes a hairpin spring wound helically around the rod under the lower lug and having arms which engage the flag so as to urge it resiliently to a position in which it projects from the guard rail towards the carriageway.

13. A road sign device adapted to be fitted to road side guard rails of crash barriers having an E-section including an upper convex portion, comprising:

a lower fixing bracket including a strip of weather resistant material shaped substantially as a hairpin with extradotal and intradotal arms which have the same arcuate profile as the upper convex portion of the guard rail to grip said upper portion resiliently, a support rod carried by said fixing bracked, and at least one reflective flag carried by said support rod wherein said flag comprises a square C-shaped frame which is open toward the rod, said frame including a pair of opposite arms ending with apertured lugs into which said rod is fitted and removably retained, said frame having a groove around its inner periphery, and a reflective sheet releasably located in the frame with its edges engaging the groove, the removal of the sheet from the open side of the frame being prevented by the lateral rod fitted into the lugs.

14. The device as set forth in claim 13, wherein the extradotal arm has a free end and an associated foot and screw means for fixing said foot to said extradotal arm, said foot being curved to embrace said upper convex part of the guard rail to prevent detachment of the bracket from the guard rail.

15. The device as defined in claim 14, wherein the bracket includes an apertured tab which extends from the foot of the hairpin so as to project from the guard rail away from the road for the selective fixing of the lower end of the rod to the apertured tab, with the flag clamped angularly on the rod in a position in which it projects towards the road and wherein said bracket further includes, towards the free end of said extradotal arm, an apertured ledge to which the lower end of said rod may be selectively fixed, and means urging said flag resiliently to the position in which it projects from the guard rail towards the road.

16. Device as defined in claim 15, wherein said frame is of plastics material.

17. Device as defined in claim 16, wherein the plastics material of the frame is relatively soft and resistant to knocks.

18. The device as defined in claim 15, wherein two opposing reflective sheets are mounted back-to-back in the frame.

19. The device as defined in claim 18, wherein the groove in the frame is in the form of a dihedron and the edges of the two opposing reflective sheets are engaged therein, said edges being bevelled with semi-dihedral angles corresponding to those of said groove.

20. The device as defined in claim 13, wherein the rod is screw threaded at its lower end and has a head at its upper end for abutting a corresponding one of the lugs, and the lower threaded end of the rod has an associated threaded member for fixing to the bracket, and including at least one spacer member located between the other lug and the bracket.

21. The device as defined in claim 20, characterized in that the spacer member is a rigid bush which prevents rotation of the flag by virtue of the clamping of the lugs between the head of the rod and the bush.

22. The device as defined in claim 21, wherein the rod is of such a length as to receive two opposing flags and including a further spacing bush interposed between the adjacent lugs of the two flags.

23. The device as defined in claim 20, characterized in that the flag is pivotable on the rod by means of its lugs, and the spacer member includes a hairpin spring would helically around the rod under the lower lug and having arms which engage the flag so as to urge it resiliently to a position in which it projects from the guard rail towards the road.

24. The device as set forth in claim 13 in which the position of the flag projects within the profile of the shape of the guard rail.

* * * * *